US006758275B2

(12) United States Patent
Martin

(10) Patent No.: US 6,758,275 B2
(45) Date of Patent: Jul. 6, 2004

(54) METHOD OF CLEANING AND REFINISHING TUBULARS

(75) Inventor: Burt Martin, Bellaire, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 5 days.

(21) Appl. No.: 10/222,544

(22) Filed: Aug. 16, 2002

(65) Prior Publication Data

US 2004/0031613 A1 Feb. 19, 2004

(51) Int. Cl.[7] ..... E21B 37/02
(52) U.S. Cl. ..... 166/311; 166/174
(58) Field of Search ..... 166/311, 170, 166/222, 223, 174; 175/408

(56) References Cited

U.S. PATENT DOCUMENTS

| | | | | |
|---|---|---|---|---|
| 4,299,282 A | | 11/1981 | Thornton | 166/177 |
| 4,705,107 A | | 11/1987 | Council et al. | 166/170 |
| 4,809,779 A | | 3/1989 | Ledyashov et al. | 166/173 |
| 5,076,365 A | | 12/1991 | Jenkins | 166/311 |
| 5,150,496 A | * | 9/1992 | Bromley | 29/33 T |
| 5,351,758 A | | 10/1994 | Henderson et al. | 166/277 |
| 5,522,124 A | | 6/1996 | Depperman | 29/90.01 |
| 5,711,046 A | | 1/1998 | Potter | 15/104.2 |
| 6,106,370 A | * | 8/2000 | Carter | 451/51 |
| 6,397,864 B1 | | 6/2002 | Johnson | 134/167 |
| 6,401,820 B1 | | 6/2002 | Kirk et al. | 166/311 |
| 6,425,444 B1 | | 7/2002 | Metcalfe et al. | 166/387 |

FOREIGN PATENT DOCUMENTS

| | | | |
|---|---|---|---|
| EP | 0 568 292 | 11/1993 | E21B/37/02 |

OTHER PUBLICATIONS

PCT Search Report, International Application No. GB 0319310.0, dated Nov. 11, 2003.

* cited by examiner

*Primary Examiner*—Roger Schoeppel
(74) *Attorney, Agent, or Firm*—Moser, Patterson & Sheridan

(57) ABSTRACT

A method for cleaning and/or altering an inside surface and shape of a tubular in a wellbore. The method includes placing a surface finishing tool in the tubular, energizing the surface finishing tool, and causing extendable assemblies therein to extend radially to contact an inside diameter of the tubular. Moving the surface finishing tool axially and/or rotationally while the extended members are in contact with the inside diameter of the tubular cleans debris from the inside surface of the tubular. In another aspect of the invention, the tool burnishes the inside diameter of the tubular, thereby altering the surface characteristics and rounding the tubular.

22 Claims, 4 Drawing Sheets

METHOD OF CLEANING AND REFINISHING TUBULARS

BACKGROUND OF THE INVENTION

1. Field of the Invention

Embodiments of the present invention generally relate to methods of cleaning scale and deposits and altering the surface and shape of the inside diameter of tubulars within an oil and gas wellbore.

2. Description of the Related Art

Hydrocarbon wells typically, begin by drilling a borehole from the earth's surface to a selected depth in order to intersect a formation. Steel casing lines the borehole formed in the earth during the drilling process. This creates an annular area between the casing and the borehole that is filled with cement to further support and form the wellbore. Thereafter, the borehole is drilled to a greater depth using a smaller diameter drill than the diameter of the surface casing. A liner may be suspended adjacent the lower end of the previously suspended and cemented casing. Production operations often require lining the borehole with a filtration medium. Examples of common filtration media include slotted pipe or tube, slotted screens or membranes, and sand-filled screens. In general, the diameter, location, and function of the tubular that is placed in the well bore determines whether it is known as casing, liner, or tubing. However, the general term tubular or tubing encompasses all of the applications.

After completing various operations during the completion of the wellbore, ledges and debris are often left on the inside diameter of the tubular. Excess cement sometimes hardens on the inside of the tubulars after cementing of the liner or casing in the wellbore. Certain downhole milling operations leave metal pieces on the inside of tubulars from either equipment remnants or burrs on the tubular itself. For example, drilling out a packer in order to remove it from the tubular may not fully eliminate all of the metal that comprised the packer. Also, milling a window in the casing to run a horizontal bore causes metal burrs on the inside of the casing around the window.

Well tubulars often become plugged or coated during production from corrosion products, sediments, and hydrocarbon deposits such as paraffin. At elevated temperatures underground paraffin is a liquid and flows easily; however, the petroleum and paraffin cools off as the petroleum travels up the well bore toward the surface. At some point the temperature drops low enough to allow the paraffin to solidify on the tubulars in the well bore. Paraffin deposits primarily present a problem for sub-sea tubulars. Other scum and deposits on the inside of tubulars consist of silicates, sulphates, sulphides, carbonates, calcium, and organic growth. Soft deposits such as clay and sand from the formations can enter the bore at locations where the casing or liner has been perforated for production. Highly deviated and horizontal bores are particularly susceptible to collecting debris.

Debris that collects on the inside surface of the tubular that defines the bore can obstruct passage through the bore of tubing, equipment, and tools used in various exploration and production operations. Even if the tool can pass through the bore, debris often causes wear and damage to the tubing, equipment, and tools that pass through it. Sustaining production rates requires periodic cleaning since deposits and solidified paraffin on the inside of production tubulars slows down production of oil from the well.

Pressure changes in the wellbore, swelling of surrounding formations, earth movements, and formation changes deform downhole tubulars. Therefore, a cross section of downhole tubulars becomes more irregular and non-round over time. Exposure to erosion and corrosion add to the roughness and inconsistent roundness of the inside surface of the tubulars. Even initially, the inside surface of a tubular is typically rough and inconsistently round. Many tools used in downhole operations require a smooth round surface in order to properly operate or make a sealing engagement with the tubular. In addition, a polished bore receptacle that allows for a non-leaking engagement between two tubulars requires a smooth, clean, and substantially round surface. Placing a seal within a polished bore receptacle insures a fluid tight seal between the tool or tubular seated within the polished bore receptacle.

In order to create a polished bore receptacle, the roughness of the tubular's inside diameter must be smoothed, and the inside diameter of the tubular must be reformed into a more uniformly round surface. Since burnishing alters a tubular's surface characteristics, burnishing the inside diameter of the tubular can establish a polished bore receptacle. Therefore, the burnished inside diameter creates a smooth and substantially round surface.

Current operations to clean the inside of tubulars include circulating treating and cleanout fluids such as water, oil, acid, corrosion inhibitors, hot oil, nitrogen, and foam in the tubular. However, physical dislodging of the debris on the tubular walls is sometimes required. Fixed diameter reaming members, scrappers, shoes on the end of tubulars, and circulating cleanout fluids do not allow the ability to clean, alter the surface finish, and/or round various sizes of tubulars during one downhole operation.

Therefore, there exists a need for an improved method of physically removing debris from the inside diameter of a wellbore tubular. There exists a further need for an improved method of burnishing the inside diameter of a wellbore tubular, thereby altering and rounding its surface characteristics.

SUMMARY OF THE INVENTION

The present invention generally relates to a method for cleaning and/or altering an inside surface finish and shape of a tubular in a wellbore. The method includes placing a surface finishing tool in the tubular, energizing the tool, and causing extendable assemblies therein to extend radially into contact with an inside diameter of the tubular. Moving the tool axially and/or rotationally while a portion of the extendable assembly is in contact with the inside diameter of the tubular cleans out debris that has collected in the tubular. In another aspect of the invention, the tool burnishes the inside diameter of the tubular, thereby altering the surface characteristics and rounding the tubular.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
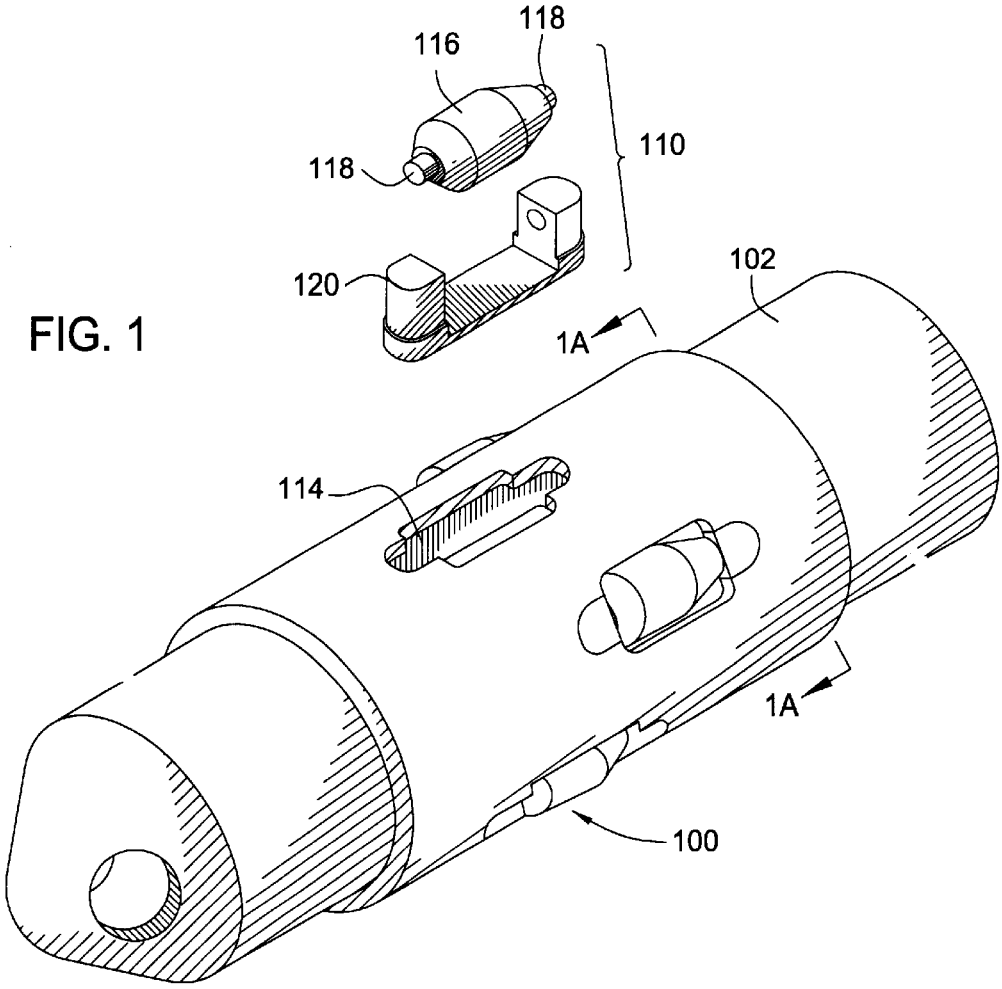
FIG. 1 is an exploded view of an embodiment of the surface finishing tool used for cleaning, resurfacing, and/or rounding wellbore tubulars.
Figure 1A:
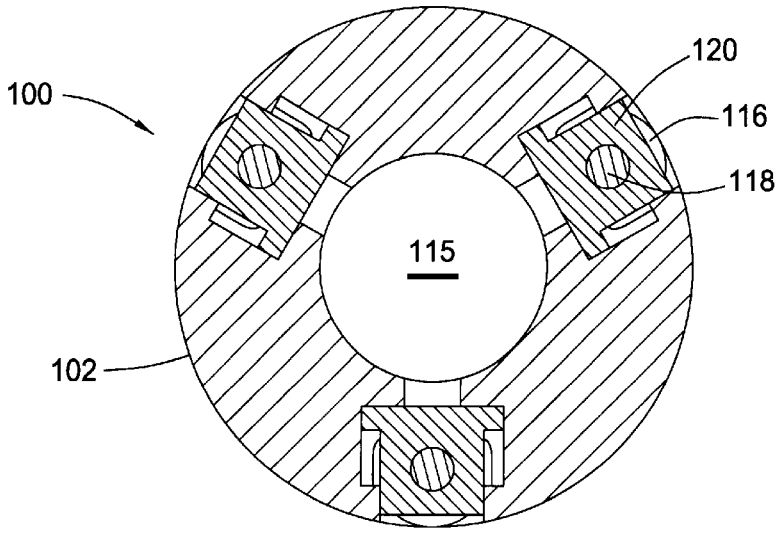
FIG. 1A is a section view across line 1A—1A of FIG. 1.

FIG. 1 shows an exploded view of the surface finishing tool 100 with a body 102 that is hollow and generally tubular. FIG. 1A presents the same surface finishing tool 100 in cross-section, with the view taken across line 1A—1A of FIG. 1. The central body 102 has a plurality of recesses 114 to hold a respective extendable assembly 110. Each of the recesses 114 has substantially parallel sides and holds a respective piston 120. The pistons 120 are radially slidable, one piston 120 being slidably sealed within each recess 114. The backside of each piston 120 is exposed to the pressure of fluid within a hollow bore 115 of the surface finishing tool 100. In this manner, pressurized fluid provided from the surface of the well can actuate the pistons 120 and cause them to extend outwardly.

Disposed above each piston 120 is a roller 116. In one embodiment of the surface finishing tool 100, the rollers 116 are near cylindrical and slightly barreled. Each of the rollers 116 is supported by a shaft 118 at each end of the respective roller 116 for rotation about a respective axis. The rollers 116 are generally parallel to the longitudinal axis of the tool 100. In the arrangement of FIG. 1, the plurality of rollers 116 is radially offset at mutual 120-degree circumferential separations around the central body 102. In the arrangement shown in FIG. 1, two offset rows of rollers 116 are shown. However, only one row, or more than two rows of roller 116, may be incorporated into the body 102. An abrasive surface may be added to the outer circumference of the rollers 116.

Figure 2:
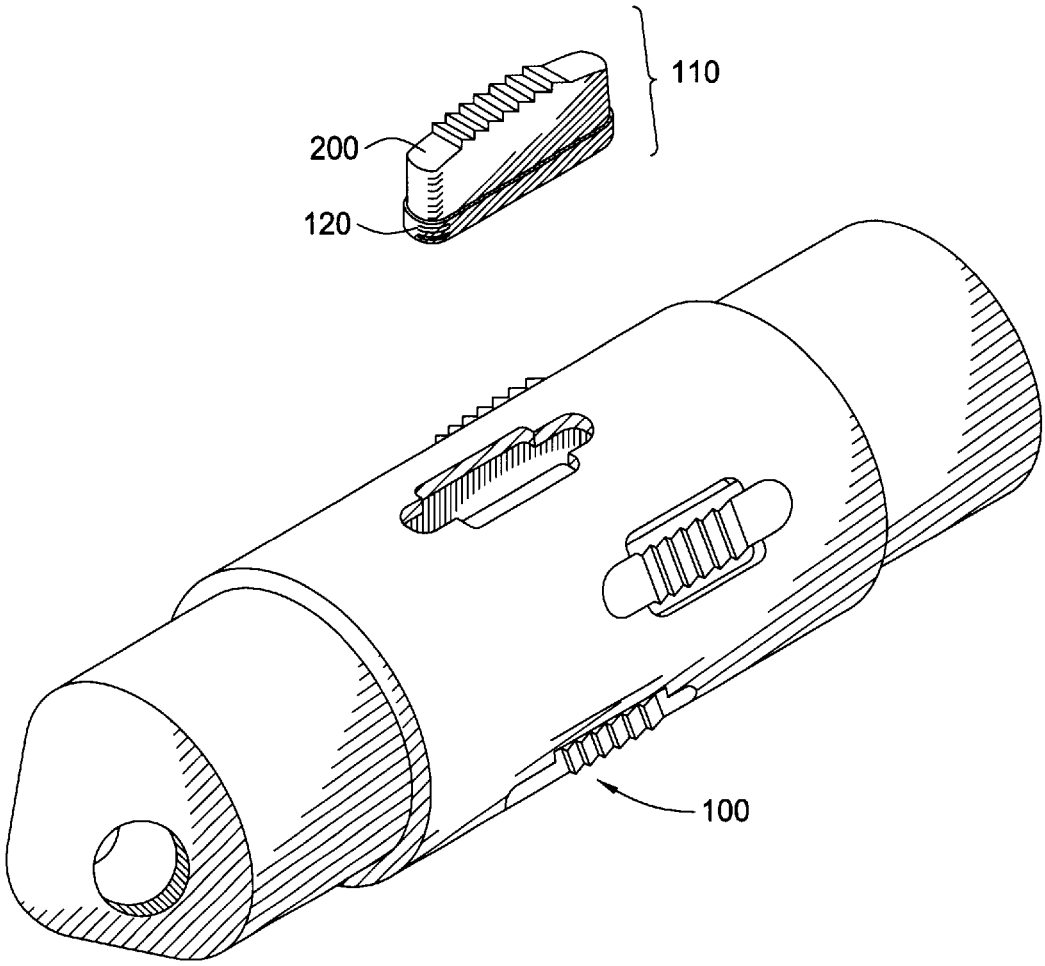
FIG. 2 is an exploded view of an alternative embodiment of the surface finishing tool.

FIG. 2 illustrates an alternative embodiment of the extendable assembly 110 of the surface finishing tool 100. Solid independent non-rolling members 200 disposed above each piston 120 replaced the rollers 116 from FIG. 1. A portion of the non-rolling member 200 opposite the piston 120 possesses a plurality of edges that form teeth. Similarly, the ends of the non-rolling members 200 that extend from the tool 100 may be hard bristles that form a brush, sharpened edges, or blades. The non-rolling member 200 can replace one or more of the rollers 116 from the embodiment shown in FIG. 1. For example, a leading offset row of extendable assemblies 110 may comprise non-rolling members 200 with brush ends while a tailing offset row of extendable assemblies 110 includes the rollers 116 shown in FIG. 1.

Figure 3:
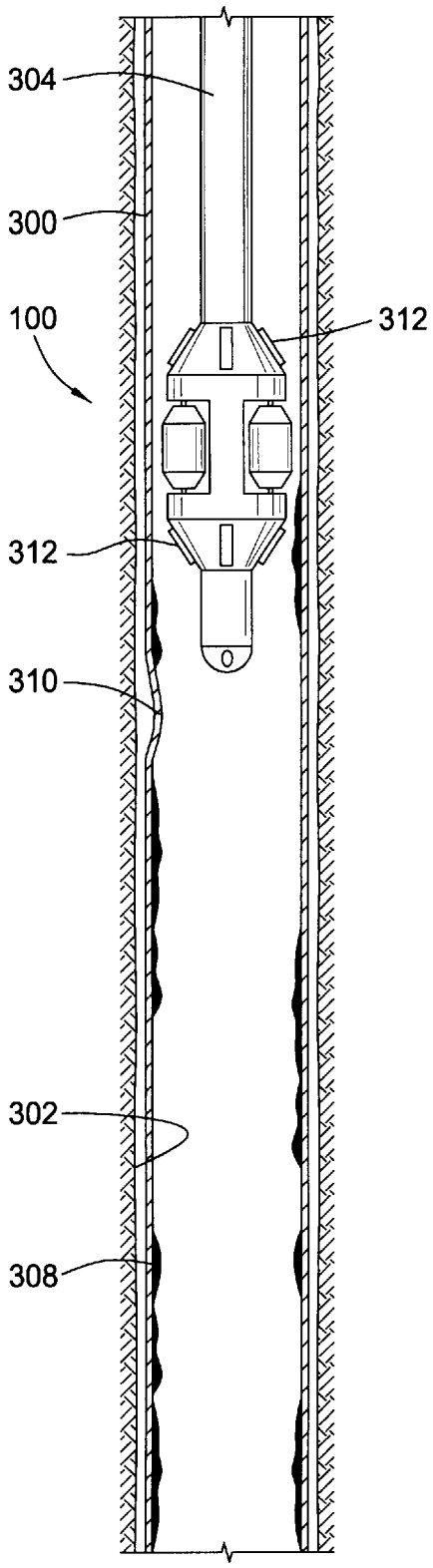
FIG. 3 is a longitudinal section view of an embodiment of the surface finishing tool as it would appear in a well bore prior to actuating the extendable assemblies.

FIG. 3 illustrates an embodiment of the present invention as it would appear positioned inside a casing 300 within a wellbore 302. In this embodiment, a plurality of non-compliant rollers 312 positioned parallel to the longitudinal axis of the tool 100 and on a portion of the tool with a gradually increasing outer diameter prevent the tool from jamming in areas of the tubulars that have a constricted inside diameter. Common known methods of lowering the surface finishing tool 100 into the wellbore include attaching the tool to a tubing string 304 or coiled tubing (not shown). If coiled tubing is utilized, a mud motor (not shown) disposed on the coiled tubing provides rotational force to the surface finishing tool 100. Both a mud motor's structure and its function are well known in the industry. In FIG. 3, the surface finishing tool 100 is illustrated in a section of casing 300 adjacent to debris 308 that is to be cleaned from the casing's inside surface and the deformation 310 that is to be rounded. While FIG. 3 illustrates the surface finishing tool positioned in casing 300, the surface finishing tool can be utilized in any downhole tubular such as liners or production tubulars.

Figure 4:
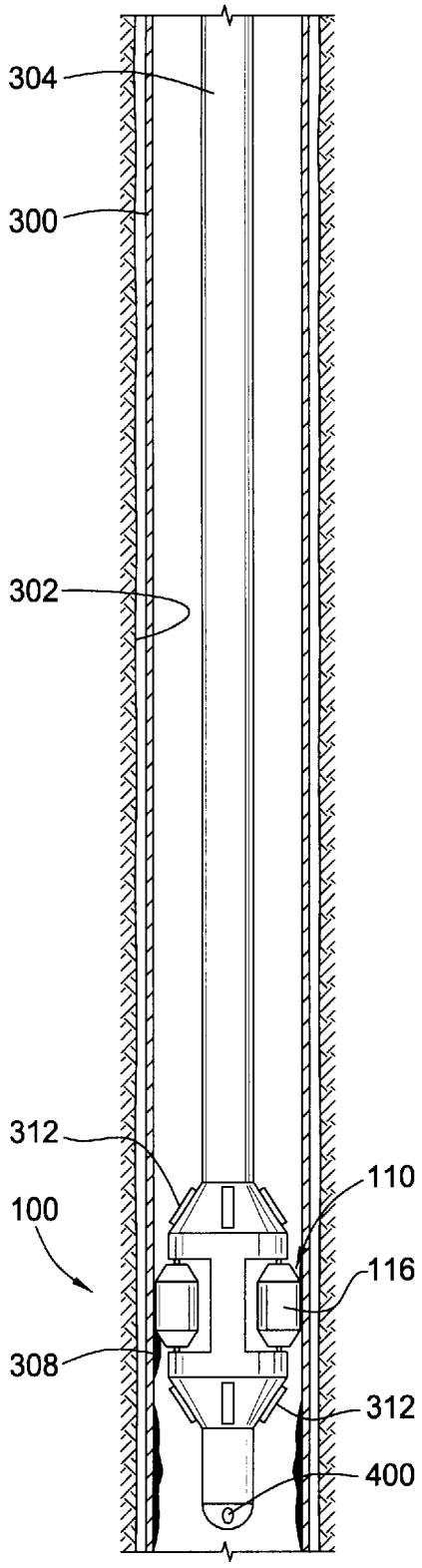
FIG. 4 is a view of the embodiment in FIG. 3 after actuating the extendable assemblies inside the tubular and moving the tool within the tubular.

FIG. 4 shows the device in FIG. 3 after the surface finishing tool 100 has been actuated and moved relative to the tubular 300. After the surface finishing tool is in place and at a predetermined time, fluid pressure applied through the tubing string 304 and into the surface finishing tool 100 extends the extendable assembly 110 radially outward into contact with the inside diameter of the tubular 300. At least one aperture 400 at the lower end of the tool 100 permits fluid to pass through the tool and circulate back to the surface. Rotating the surface finishing tool 100 in the tubular and/or moving the surface finishing tool 100 axially in the tubular while a portion of the extendable assemblies 110 contact the inside diameter of the tubular 300 physically dislodges debris 308 from the inside surface of the tubular 300. While FIG. 4 shows extendable assemblies 110 with rollers 116 contacting the inside diameter of the tubular, extendable assemblies 110 with the solid independent non-rolling members described herein can be utilized to clean debris 308 from the tubular 300. The type of debris 308 to be cleaned from the inside surface determines whether the roller 116 or one of the non-rolling members that utilize brushes, teeth, or edges will provide the most efficient cleaning. Outward radial force applied by the surface finishing tool 100 reshapes the inside circumference of the tubular 300 into a more uniformly round shape as the tool rotates inside the irregular section 310 (shown in FIG. 3). Axial and rotational movement of the tubing string 304 from the surface moves the surface finishing tool 100 respectively within the tubular.

A surface finishing tool with the same features as described in FIG. 1 or FIG. 2 can be used to burnish the inside diameter of a tubular in order to prepare a polished bore receptacle. The term burnish refers broadly to any changes in the surface characteristics of the tubular's inside diameter. Continued rotation of the tool 100 while the rollers 116 contact the inside diameter of the tubular 300 burnishes a section of the inside diameter of the tubular. Prior to burnishing, the surface finishing tool 100 has cleaned the inside surface of the tubular and reformed the inside surface into a more rounded shape. Burnishing and rounding the inside surface of the tubular 300 with the finishing tool 100 after removing debris 308 with other known apparatuses utilizes the finishing tool in conjunction with other known cleaning devices. The smoothed, cleaned, polished, and substantially rounded inside surface of the tubular as shown in FIG. 4. provides the required surface and finish needed for a polished bore receptacle. Therefore, a second tubular or tool can be seated within the polished bore receptacle to provide a fluid tight seal.

Figure 5:
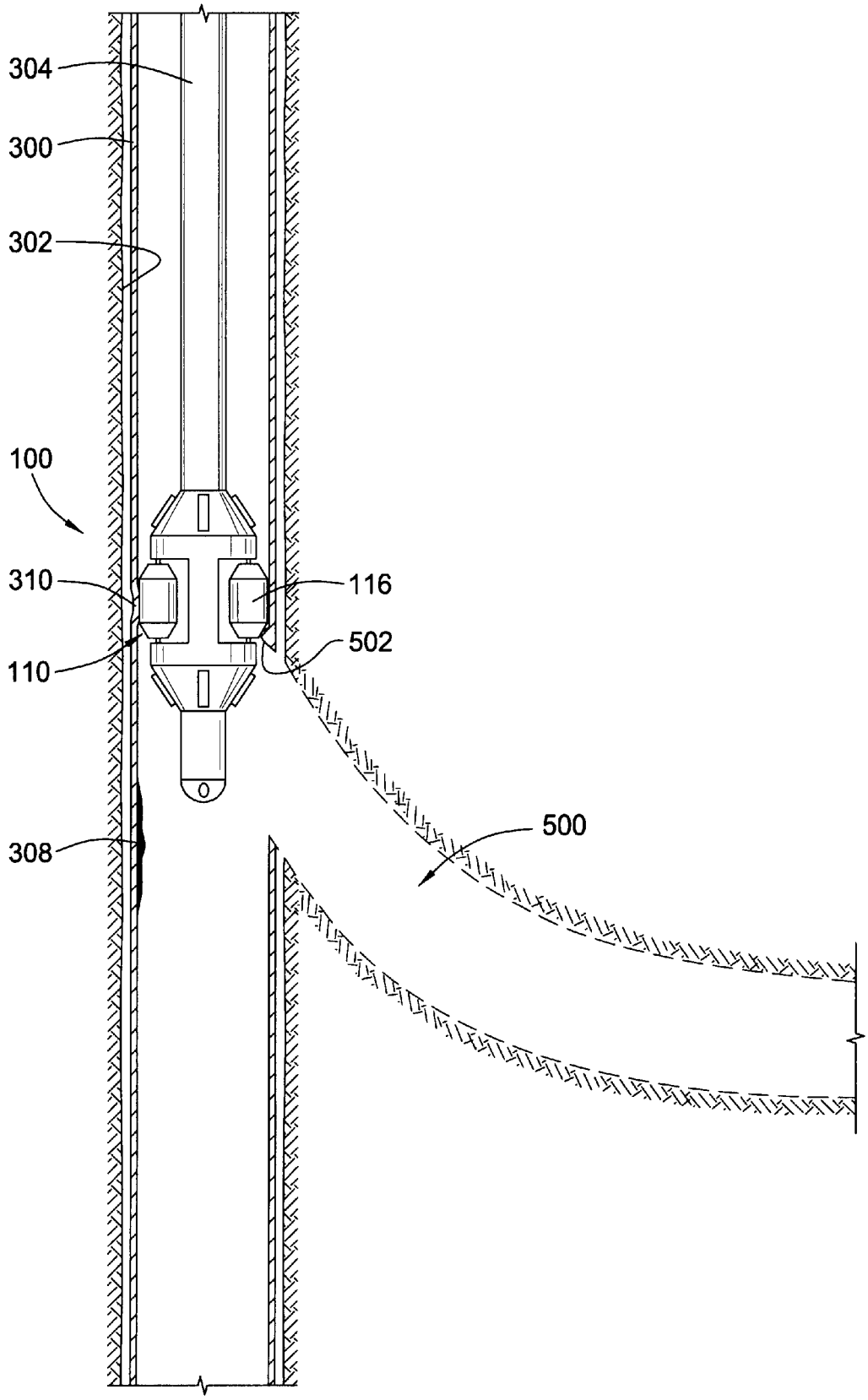
FIG. 5 is a longitudinal section view of an embodiment of the surface finishing tool as it would appear within casing having a window formed in a wall thereof.

FIG. 5 illustrates the surface finishing tool 100 inside a casing 300 that a window 500 has been milled through a wall thereof. The milling process left metal burrs 502 circumscribing the window 500. Fluid pressure applied to the surface finishing tool 100 extends the extendable assembly 110 until the rollers 116 contact the inside diameter of the casing 300. Therefore, moving the actuated surface finishing tool 100 across the window 500 removes the metal burrs 502. As the surface finishing tool moves axially through the casing 300 the irregularity 310 is formed into a more rounded inside surface and debris 308 is removed. Therefore, the altered inside surface of the casing 300 permits substantially unobstructed fluid flow through the casing and allows passage of subsequent downhole tools without the risk of damage or becoming stuck since the burr 502, the irregular shape 310, and the debris 308 have all been removed or reformed. During one downhole operation with the finishing tool 100, tubulars with multiple sizes of inside diameters can be refinished since the tool's diameter varies with the extension of the extendable assemblies 110.

While the foregoing is directed to embodiments of the present invention, other and further embodiments of the invention may be devised without departing from the basic scope thereof, and the scope thereof is determined by the claims that follow.

What is claimed is:

1. A method of cleaning an inside diameter of a downhole tubular in a wellbore, comprising:

running the tubular into the wellbore;

running a workstring into the tubular, the workstring including a surface finishing tool at the end thereof, the tool having at least one radially extendable assembly mounted thereon;

energizing the surface finishing tool and causing the at least one extendable assembly therein to extend radially to contact the inside diameter of the tubular; and moving the tool within the tubular, thereby cleaning the inside diameter.

2. The method of claim 1, wherein the moving includes axial movement of the tool relative to the wellbore.

3. The method of claim 1, wherein the moving includes rotational movement of the tool relative to the wellbore.

4. The method of claim 1, wherein the moving includes axial and rotational movement of the tool relative to the wellbore.

5. The method of claim 1, wherein the workstring is coiled tubing.

6. The method of claim 5, wherein rotational movement of the tool within the tubular is accomplished by a mud motor disposed on the coiled tubing above the tool.

7. The method of claim 1, wherein the at least one extendable assembly includes a roller for contacting the inside diameter.

8. The method of claim 1, wherein the at least one or more extendable assembly includes at least one member having an edge formed thereupon, the edge constructed and arranged to contact and remove material disposed on the inside diameter.

9. A method of altering an inside surface of a downhole tubular in a wellbore, comprising:

running the tubular into the wellbore;

running a workstring into the tubular the workstring including a surface finishing tool at the end thereof, the tool having at least one radially extendable assembly mounted thereon;

energizing the surface finishing tool and causing the extendable assemblies therein to extend radially to contact the inside surface of the tubular; and moving the tool within the tubular member, thereby altering the inside surface.

10. The method of claim 9, wherein altering the inside surface includes reforming the surface into a more uniformly round shape.

11. The method of claim 9, wherein altering the inside surface includes burnishing the inside surface of the tubular.

12. The method of claim 9, wherein altering the inside surface includes reforming the surface into a more uniformly round shape and burnishing the inside surface, thereby forming a polished bore receptacle.

13. The method of claim 9, wherein the moving includes axial movement of the tool relative to the wellbore.

14. The method of claim 9, wherein the moving includes rotational movement of the tool relative to the wellbore.

15. The method of claim 9, wherein the moving includes axial and rotational movement of the tool relative to the wellbore.

16. The method of claim 9, wherein the workstring is coiled tubing.

17. The method of claim 16, wherein rotational movement of the tool within the tubular is accomplished by a mud motor disposed on the coiled tubing above the tool.

18. A method of cleaning an inside diameter of a downhole tubular in a wellbore, comprising:

placing a surface finishing tool in the downhole tubular, the surface finishing tool is disposed on coiled tubing and the surface finishing tool having at least one radially extendable assembly mounted thereon;

energizing the surface finishing tool and causing the at least one radially extendable assembly therein to extend radially to contact the inside diameter of the downhole tubular; and moving the surface finishing tool within the downhole tubular, thereby cleaning the inside diameter.

19. A method of altering an inside surface of a downhole tubular in a wellbore, comprising:

placing a surface finishing tool in the tubular, the surface finishing tool is disposed on a tubular string and the surface finishing tool having at least one radially extendable assembly mounted thereon;

energizing the surface finishing tool and causing the extendable assemblies therein to extend radially to contact the inside surface of the tubular; and moving the tool within the tubular member, thereby altering the inside surface, wherein altering the inside surface includes burnishing the inside surface of the tubular.

20. The method of claim 19, wherein altering the inside surface further includes reforming the surface into a more uniformly round shape, thereby forming a polished bore receptacle.

21. The method of claim 19, wherein the at least one radially extendable assembly includes at least one roller.

22. A method of conditioning an inside diameter of a downhole tubular in a wellbore, comprising:

placing a surface finishing toll in the downhole tubular, the surface finishing toll is diposed on coiled tubing and the surface finishing tool having at least one radially extendable assembly mounted thereon;

energizing the surface finishing toll and causing the at least one radially extendable assembly therein to extend radially to contact the inside diameter of the downhole tubular; and moving the surface finishing tool within the downhole tubular, thereby conditioning the inside diameter.

* * * * *